US009460733B2

(12) United States Patent
Kim et al.

(10) Patent No.: US 9,460,733 B2
(45) Date of Patent: Oct. 4, 2016

(54) APPARATUS AND METHOD FOR EXTENDING BANDWIDTH OF SOUND SIGNAL

(71) Applicant: GWANGJU INSTITUTE OF SCIENCE AND TECHNOLOGY, Gwangju (KR)

(72) Inventors: Hong Kook Kim, Gwangju (KR); Nam In Park, Gwangju (KR)

(73) Assignee: GWANGJU INSTITUTE OF SCIENCE AND TECHNOLOGY, Gwangju (KR)

( * ) Notice: Subject to any disclaimer, the term of this patent is extended or adjusted under 35 U.S.C. 154(b) by 0 days.

(21) Appl. No.: 14/301,870

(22) Filed: Jun. 11, 2014

(65) Prior Publication Data

US 2015/0112692 A1 Apr. 23, 2015

(30) Foreign Application Priority Data

Oct. 23, 2013 (KR) ..... 10-2013-0126286

(51) Int. Cl.
*G10L 19/00* (2013.01)
*G10L 21/038* (2013.01)
*G10L 19/02* (2013.01)

(52) U.S. Cl.
CPC ..... *G10L 21/038* (2013.01); *G10L 19/0212* (2013.01)

(58) Field of Classification Search
CPC . G10L 19/0212; G10L 19/022; G10L 19/06; G10L 19/20; G10L 19/24; G10L 19/0204; G10L 19/0208
USPC ..... 704/500, 203, 205, 207, 219, 222, 230, 704/231, 268, 503; 702/189; 713/176
See application file for complete search history.

(56) References Cited

U.S. PATENT DOCUMENTS 5,732,188 A * 3/1998 Moriya ..... G10L 19/06 704/200.1
5,732,386 A * 3/1998 Park ..... H04H 20/88 381/2
5,983,172 A * 11/1999 Takashima ..... G10L 19/002 704/203
6,904,404 B1 * 6/2005 Norimatsu ..... G10L 19/032 704/222

(Continued)

OTHER PUBLICATIONS

Nam In Park., Model-Based Extension Techniques for Scalable Speech Coders, article, May 22, 2013, 143p , Dissertation for Doctor of Philosophy.

*Primary Examiner* — Michael Colucci
(74) *Attorney, Agent, or Firm* — Hauptman Ham, LLP

(57) ABSTRACT

Disclosed is an apparatus for extending a bandwidth of a sound signal. The apparatus includes a database that stores predetermined training information as a result of at least one of Gaussian mixture model (GMM) training and hidden Markov model (HMM) training; a modified discrete cosine transform (MDCT) transformer that transforms a first band signal through MDCT, a feature extractor that extracts a feature parameter of the first band signal from an MDCT coefficient output from the MDCT transformer; an extender that provides an extended MDCT coefficient for a second band signal based on the MDCT coefficient of the first band signal output from the MDCT transformer, a subband energy estimator that estimates subband energy of the second band signal with reference to information stored in the database based on the feature parameter.

19 Claims, 3 Drawing Sheets

(56) References Cited

U.S. PATENT DOCUMENTS 8,209,188 B2 * 6/2012 Oshikiri ..... G10L 19/24 704/200
8,595,019 B2 * 11/2013 Geiger ..... G10L 19/0212 704/219
2002/0178012 A1 * 11/2002 Wang ..... G10H 1/0058 704/503
2003/0093271 A1 * 5/2003 Tsushima ..... G10L 19/0208 704/230
2005/0060147 A1 * 3/2005 Norimatsu ..... G06Q 20/10 704/230
2005/0165587 A1 * 7/2005 Cheng ..... G10L 19/0212 702/189
2006/0031075 A1 * 2/2006 Oh ..... G10L 21/038 704/500
2007/0300066 A1 * 12/2007 Srinivasan ..... G10L 19/018 713/176
2010/0070269 A1 * 3/2010 Gao ..... G10L 19/04 704/207
2010/0121646 A1 * 5/2010 Ragot ..... G10L 19/0204 704/500
2010/0198587 A1 * 8/2010 Ramabadran ..... G10L 19/06 704/205
2011/0173010 A1 * 7/2011 Lecomte ..... G10L 19/20 704/500
2011/0202337 A1 * 8/2011 Fuchs ..... G10L 19/20 704/231
2013/0262122 A1 * 10/2013 Kim ..... G10L 19/02 704/268
2013/0289981 A1 * 10/2013 Ragot ..... G10L 19/022 704/219
2014/0074489 A1 * 3/2014 Chong ..... G10L 19/20 704/500

* cited by examiner

APPARATUS AND METHOD FOR EXTENDING BANDWIDTH OF SOUND SIGNAL

CROSS-REFERENCE TO RELATED APPLICATION

This application claims priority to Korean Patent Application No. 10-2013-0126286 filed on 23 Oct. 2013, and all the benefits accruing therefrom under 35 U.S.C. §119, the contents of which is incorporated by reference in its entirety.

BACKGROUND

1. Technical Field

The present invention relates to an apparatus and method for extending a bandwidth of a sound signal.

2. Description of the Related Art

Recently, Internet-based phone services have entered widespread use. Widespread use of Internet-based phone services results from realization of communication based on a super wideband of 50-14000 Hz and providing higher quality than existing communication networks. Codecs, which support super wideband communication, include G.729.1SWB (super wideband) proposed by ITU-T, and the like.

Codecs, which support super wideband communication, have a feature of embedded variable bitrates. Therefore, the codec encodes information at a lower bitrate, when the number of users increases, communication congestion occurs, and the like. Here, low bitrate information is a narrowband signal and thus only information about low band sound carrying a lot of voice information is transmitted. Accordingly, it is advantageously possible to prevent sharp deterioration in call quality due to packet loss, to improve service connectivity, and to permit communication and interaction between heterogeneous terminals having different communication abilities.

However, if transmission is performed at a low bitrate, there can be user inconvenience due to recognizable deterioration in call quality, even though it is possible to prevent sharp deterioration in call quality. Such a problem is more serious when service quality is sharply degraded due to sudden deterioration of a communication network. In particular, such a problem occurs more frequently and becomes further serious when a user terminal connected to a wireless Internet protocol network moves.

BRIEF SUMMARY

The present invention has been conceived to solve such problems in the art, and it is an aspect of the present invention to provide an apparatus and method for extending a bandwidth of a sound signal such that high call quality can be achieved additional bit assignment in a communication network for the Internet.

In accordance with one aspect of the present invention, an apparatus for extending a bandwidth of a sound signal includes: a database that stores predetermined training information as a result of at least one of Gaussian mixture model (GMM) training and hidden Markov model (HMM) training; a modified discrete cosine transform (MDCT) transformer that transforms a first band signal through MDCT; a feature extractor that extracts a feature parameter of the first band signal from an MDCT coefficient output from the MDCT transformer; an extender that provides an extended MDCT coefficient for a second band signal based on the MDCT coefficient of the first band signal output from the MDCT transformer; a subband energy estimator that estimates subband energy of the second band signal with reference to information stored in the database based on the feature parameter; a second band signal generator that provides an extended MDCT coefficient for the second band signal and an MDCT coefficient of an estimated second band signal using the subband energy of the estimated second band signal; an inverse MDCT transformer that provides the estimated second band signal by transforming the MDCT coefficient of the estimated second band signal through inverse MDCT; and a synthesizer that obtains a third band signal by synthesizing the estimated second band signal and the first band signal.

The apparatus may further comprise a normalizer that normalizes the MDCT coefficient of the first band signal output from the MDCT transformer and outputs the normalized MDCT coefficient to the extender. Thus, it is possible to provide a soft sound. The feature parameter may include a subband energy vector of the first band signal. In addition, the first band signal may include a low band signal and the third band signal may include a wideband signal, or the first band signal may include a wideband signal or a narrowband signal and the third band signal may include a super wideband signal. Further, the first band signal may be input to the synthesizer without MDCT, or input to the synthesizer after undergoing MDCT and inverse MDCT. The extender may provide an extended MDCT coefficient for the second band signal by applying correlation-based spectral band replication to the MDCT coefficient of the first band signal. Therefore, it is possible to obtain a second band signal more similar to the first band signal.

In accordance with another aspect of the present invention, a method of extending a bandwidth of a sound signal includes: estimating a second band signal based on a first band signal; and obtaining a third band signal by synthesizing the first band signal and the second band signal, wherein estimating the second band signal includes estimating subband energy of the second band signal with reference to information about Gaussian mixture model (GMM) training or hidden Markov model (HMM) training stored in a database based on a feature parameter of the first band signal, obtaining an extended MDCT coefficient for the second band signal through an MDCT coefficient of the first band signal, and obtaining an MDCT coefficient of the estimated second band signal based on subband energy of the estimated second band signal and the extended MDCT coefficient for the second band signal.

The extended MDCT coefficient for the second band signal may be obtained by applying correlation-based spectral band replication to the MDCT coefficient of the first band signal. Thus, it is possible to obtain a second band signal that more closely approaches the first band signal. In addition, the first band signal may include a low band signal and the third band signal may include a wideband signal, or the first band signal may include a wideband signal or a narrowband signal and the third band signal may include a super wideband signal. Thus, it is possible to extend the bandwidths of various signals.

According to the present invention, a high quality call service can be realized under conditions that a communication network for the Internet is deteriorated. In particular, it is possible to achieve high call quality even when a user terminal connected to a wireless Internet protocol network frequently moves. Further, it is possible to achieve a high quality call service without additional bit assignment.

BRIEF DESCRIPTION OF THE DRAWINGS

The above and other aspects, features, and advantages of the present invention will become apparent from the detailed description of the following embodiments in conjunction with the accompanying drawings, in which.

DETAILED DESCRIPTION

Figure 1:
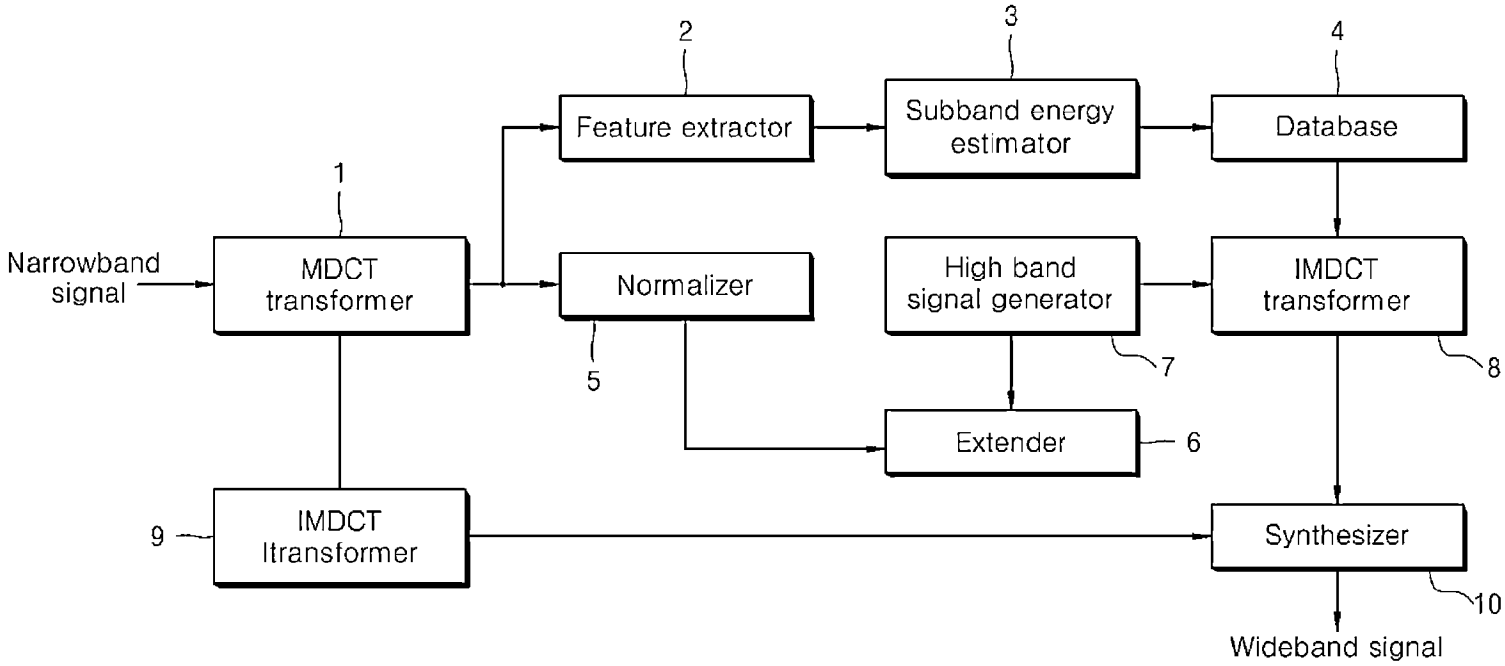
FIG. 1 is a block diagram of an apparatus for extending a bandwidth of a sound signal in accordance with one embodiment of the present invention.

Hereinafter, embodiments of the invention will be described in detail with reference to the accompanying drawings. It should be understood that the present invention is not limited to the following embodiments and may be embodied in different ways, and that the embodiments are given to provide complete disclosure of the invention and to provide thorough understanding of the invention to those skilled in the art. The scope of the invention is limited only by the accompanying claims and equivalents thereof. Like components will be denoted by like reference numerals throughout the specification.

<Apparatus for Extending Bandwidth of Sound Signal>

FIG. 1 is a block diagram of an apparatus for extending a bandwidth of a sound signal in accordance with one embodiment of the present invention;

Referring to FIG. 1, the apparatus for extending a bandwidth of a sound signal according to the embodiment of the invention includes a modified discrete cosine transform (MDCT) transformer 1 that transforms an input narrowband signal through MDCT, a feature extractor 2 that extracts subband energy of the narrowband signal as a feature parameter, a database 4 that stores information provided as a result of Gaussian mixture model (GMM) training or hidden Markov model (HMM) training using reference audio material, and a subband energy estimator 3 that estimates subband energy of a high band signal with reference to the information stored in the database 4 based on the subband energy of the narrowband signal provided from the feature extractor 2.

The narrowband signal is a low band signal in a frequency band of about 0-4 kHz, and the high band signal is in a frequency band of 4-8 kHz. Herein, the narrowband signal can also be referred to as the low band signal.

The apparatus according to the embodiment of the present invention further includes a normalizer 5 that normalizes the MDCT coefficient extracted from the MDCT transformer 1, an extender 6 that extends the normalized MDCT coefficient output from the normalizer 5 into a high band, and a high band signal generator 7 that obtains a MDCT coefficient of the estimated high band signal based on the extended MDCT coefficient provided from the extender 6 and the estimated subband energy provided from the subband energy estimator 3.

Here, the extender 6 is a block for providing the extended MDCT coefficient for the high band signal by replicating the normalized low band signal in a predetermined method, in which the extender 6 may perform correlation-based spectral band replication to provide the extended MDCT coefficient for the high band signal.

In addition, the apparatus further includes an inverse MDCT transformer 7 that obtains an estimated high band signal by transforming the MDCT coefficient of the estimated high band signal through inverse MDCT, an IMDCT transformer 9 that transforms the MDCT coefficient of the narrowband signal through inverse MDCT, and a synthesizer 10 that synthesizes the MDCT coefficient of the estimated high band signal with the signal output from the IMDCT transformer 9 for inverse MDCT. The signal output from the synthesizer 10 is a wideband signal, in which the low band signal in a frequency band of 0-4 kHz and the high band signal in a frequency band of 4-8 kHz may be synthesized.

Hereinafter, the configuration and operation of the apparatus according to the embodiment of the invention will be described in more detail.

First, a process of providing information stored in the database 4 will be described. To provide the information stored in the database 4, various training processes may be performed. For example, GMM training or HMM training may be performed. As training data for performing GMM training or HMM training, 50 standard audio data may be prepared. The standard audio data may be obtained from sound quality assessment material (SQAM).

The training data may store information about a signal in a frequency band of 0-8 kHz as the wideband signal. In other words, the wideband signal may include a low band signal $x_n(n)$ in a frequency band of 0-4 kHz and a high band signal $x_h(n)$ in a frequency band of 4-8 kHz. If an object for extending a bandwidth and an extending target are varied, the training data may also be varied.

The low band signal and the high band signal are transformed through MDCT, and thus the subband energy thereof may be calculated independently. Each subband energy may be expressed by Expression 1.

$$E_n(b) = \sqrt{\sum_{k=16b}^{16(b+2)} X_n^2 k}\ ,\ E_h(b) = \sqrt{\sum_{k=16b}^{16(b+2)} X_h^2 k} \qquad \text{⟨Expression 1⟩}$$

In Expression 1, b has a value ranging from 0 to 8, $X_n(k)$ is the MDCT coefficient of the $k^{th}$ frequency band of $x_n(n)$, and $X_h(k)$ is the MDCT coefficient of the $k^{th}$ frequency band of $x_h(n)$. Therefore, $E_n(b)$ refers to energy of the low band signal in the $b^{th}$ subband, and $E_h(b)$ refers to energy of the high band signal in the $b^{th}$ subband. In this embodiment, the number of subbands is 9, but the present invention is not limited thereto.

The subband energy of each frame may be given as a feature parameter in the GMM training or HMM training. Let $E_b=[E_n(0), E_n(1), \ldots E_n(8)]$ be a spectrum subband energy vector of the low band signal and $E_h=[E_h(0), E_h(1), \ldots E_h(8)]$ be a spectrum subband energy vector of the high band signal. Further, two subband energy vectors are connected to each other and expressed by $E=[E_n, E_h]$.

The subband energy vectors of the low band signal and the high band signal as the parameters for GMM training or HMM training may be trained by an expectation-maximization (EM) algorithm. Each piece of information provided through the foregoing procedure may be stored in the database 4. In the case of the EM algorithm, the parameters may differ according to GMM training or HMM training, but are the same in that both parameters for estimating the subband energy of the high band signal are obtained through the training process.

Now, the apparatus for extending a bandwidth of a sound signal will be described.

Referring to FIG. 1 again, the MDCT transformer 1 transforms the input sound signal, that is, the narrowband signal, into the MDCT domain. The MDCT coefficient $S_n(k)$ of the narrowband signal is input to the feature extractor 2 to extract the $b^{th}$ subband energy $E_n(b)$ of the narrowband signal. The $b^{th}$ subband energy $E_n(b)$ of the narrowband signal may be used not only for normalization in the normalizer 5 but also for estimation of the subband energy from the high band signal in the subband energy estimator 3. The $b^{th}$ subband energy $E_n(b)$ of the narrowband signal may be obtained by the same method as in Expression 1 except that $X_n(k)$ is replaced by $S_n(k)$ in Expression 1. The subband energy of the narrowband signal may be expressed as a vector $E_n$.

In the normalizer 5, the MDCT coefficient of the narrowband signal is normalized to obtain an MDCT coefficient $\overline{S}_n(k)$ of a normalized narrowband signal. In the normalizer 5, normalization may be performed using Expression 2. Alternatively, normalization may be performed by other methods.

$$\overline{S}_n(k) = \begin{cases} S_n(k),\ 0 \le k < 16 \\ \dfrac{S_n(k)\omega(k-16(b-1))}{E_n(b-1)} + \dfrac{S_n(k)\omega(k-16b)}{E_n(b)},\ 16 \le k < 144 \\ \dfrac{S_n(k)}{E_n(b-1)},\ 144 \le k < 160 \end{cases} \quad \text{⟨Expression 2⟩}$$

where, $b=\lfloor k/16 \rfloor$, $\overline{S}_n(k)$ is the MDCT coefficient of the normalized narrowband signal, and $\omega(l)$ is a cosine window having a length of 32. $\overline{S}_n(k)$ may be transformed into the extended MDCT coefficient for the high band signal through the extender 6. In this embodiment, the MDCT coefficient of the normalized narrowband signal is simply shifted and regarded as the extended MDCT coefficient for the high band signal.

In the subband energy estimator 3, a minimum mean squared error (MMSE) method based on GMM training or HMM training may be used to estimate the $b^{th}$ subband energy $\hat{E}_h(b)$ of the estimated high band signal. Here, the $b^{th}$ subband energy of the estimated high band signal may be estimated with reference to the $b^{th}$ subband energy vector $E_n(b)$ the narrowband signal. The MMSE method may be varied in the expression depending on the GMM training or HMM training method and other detailed patterns, but invariable in that the subband energy of the low band signal is used to estimate the subband energy of the high band signal.

In the high band signal generator 7, the MDCT coefficient of the estimated high band signal is provided using the extended MDCT coefficient (corresponding to $\overline{S}_n(k)$ since simple shift is performed in this embodiment) for the high band signal provided from the extender 6 and the $b^{th}$ subband energy $\hat{E}_h(b)$ of the estimated high band signal provided from the subband energy estimator 3.

The MDCT coefficient $S_{abe}(k)$ the estimated high band signal may be obtained by Expression 3 and Expression 4.

$$\tilde{S}'_h(k) = \begin{cases} \overline{S}_n(k)\hat{E}_h(b),\ 0 \le k < 16 \\ \overline{S}_n(k)\hat{E}_h(b-1)\omega(k-16(b-1)) + \\ \overline{S}_n(k)\hat{E}_h(b)\omega(k-16b),\ 16 \le k < 144 \\ \overline{S}_n(k)\hat{E}_h(b-1),\ 16 \le k < 144 \end{cases} \quad \text{⟨Expression 3⟩}$$

$\tilde{S}'_h(k)$ obtained by Expression 3 can rapidly vary, causing listener inconvenience, and thus a smoothing process may further be performed. The smoothing operation may be performed based on Expression 4.

$$S_{abe(k)} = (0.25 \cdot |\hat{S}'_h(k)| + 0.25 \cdot |S_{abe}(k-1)| \cdot \mathrm{sgn}(\hat{S}'_h(k)), \quad \text{<Expression 4>}$$

where subscript of "abe" is an abbreviation for Artificial Bandwidth Extension, which shows an MDCT coefficient extended into the high band, sgn(x) becomes 1 when x is equal to or higher than 0 but otherwise becomes −1, and k is an index of a frequency band ranging from 0 to 119.

The MDCT coefficient $S_{abe}(k)$ of the estimated high band signal is transformed into the time domain in the inverse MDCT transformer 8. Further, the synthesizer 10 synthesizes the time domain signals output from the inverse MDCT transformers 8 and 9, thereby providing a wideband signal. The synthesizer may employ a query management facility (QMF) filter.

In the foregoing embodiment, the narrowband signal in a frequency band of about 0-4 kHz is extended into the wideband signal in a frequency band of about 0-8 kHz. However, the apparatus according to the present invention is not limited thereto and may be used to extend a bandwidth from a wideband signal of 0-8 kHz into a super wideband signal of 0-16 kHz. In this case, the number of MDCT coefficients, the method of extending the MDCT coefficient in the extender, frame size, and the like may be changed. In this way, it will also be appreciated that a narrowband of 0-4 kHz is extended into the super wideband.

In the apparatus according to the present invention, there is an advantage of obtaining a wideband or super wideband signal by artificially extending a transmitted signal without additional bit assignment. In addition, high quality call can be secured even though a communication network is deteriorated or a terminal is frequently moved.

<Method of Extending Bandwidth of Sound Signal>

A method of extending a bandwidth of a sound signal in accordance with one embodiment of the present invention may use the apparatus for extending a bandwidth of a sound signal in accordance with the embodiment of the invention, or use other apparatuses.

Figure 2:
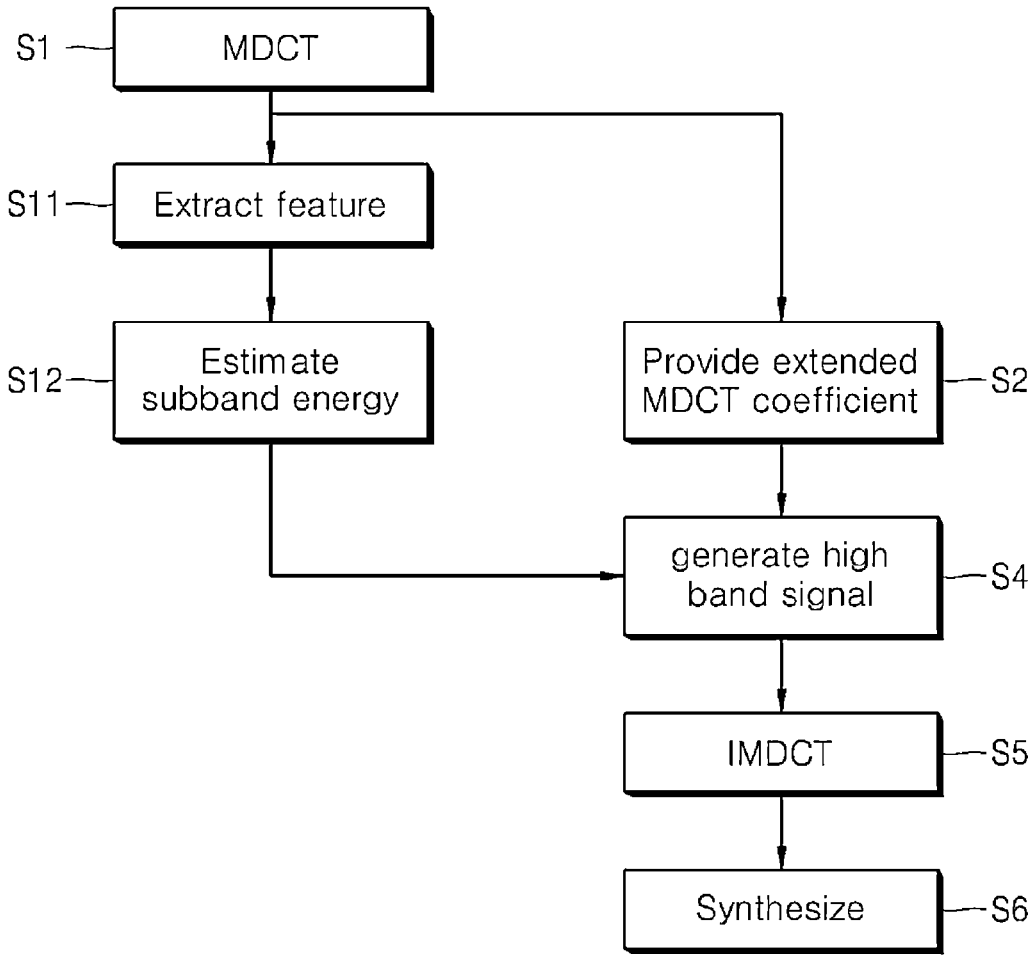
FIG. 2 is a flowchart of a method of extending a bandwidth of a sound signal in accordance with one embodiment of the present invention.

FIG. 2 is a flowchart of a method of extending a bandwidth of a sound signal in accordance with one embodiment of the present invention.

Referring to FIG. 2, when a low band signal is input, the low band signal is transformed through MDCT (S1), and a feature parameter of the transformed MDCT coefficient is extracted (S11). Here, a subband energy vector of the low band signal may be used as an extracted value. Estimated subband energy of a high band signal is obtained with reference to information previously stored in a database based on the extracted feature parameter (S12).

The MDCT coefficient of the low band signal is used to provide an extended MDCT coefficient for the high band signal (S2). The extended MDCT coefficient for the high band signal may be provided by normalizing the MDCT coefficient of the low band signal and applying correlation-based spectral band replication to the MDCT coefficient of the normalized low band signal.

Using the extended MDCT coefficient for the high band signal and the estimated subband energy, a MDCT coefficient of an estimated high band signal is obtained (S4). The MDCT coefficient of the estimated high band signal is transformed through inverse MDCT and thus the estimated high band signal in the time domain is obtained (S5). Lastly, the input low band signal and the estimated high band signal are synthesized to provide a wideband signal (S6).

In the method of extending a bandwidth of a sound signal according to the embodiment of the invention, it is possible to extend a narrowband signal into a wideband signal without additional bit assignment, or to extend a wideband signal into a super wideband signal. In addition, it is possible to achieve a wideband or super wideband even though a communication network is deteriorated, thereby achieving high call quality.

<Evaluation>

Figure 3:
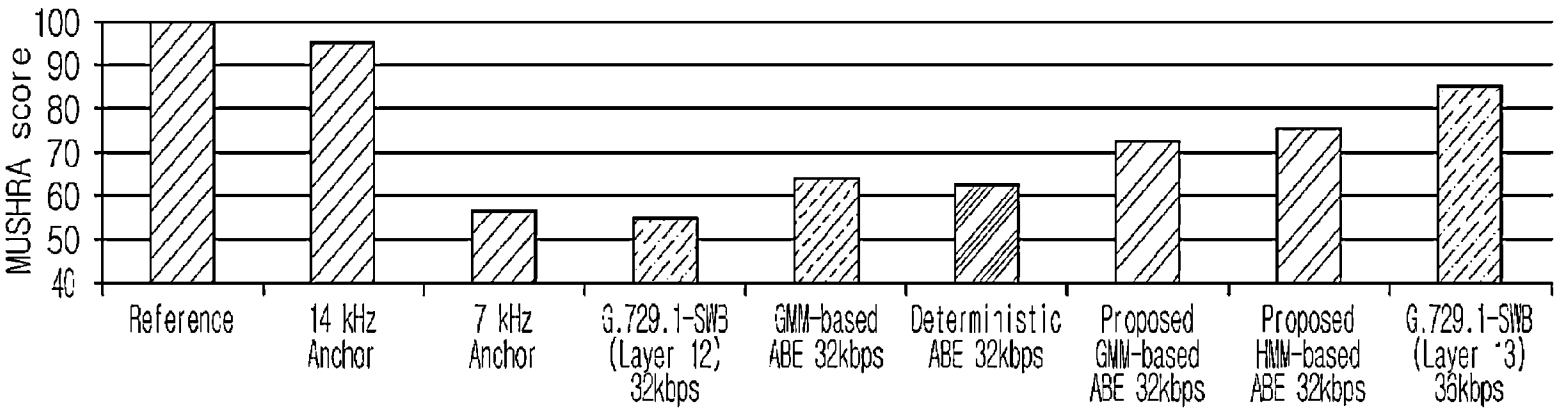
FIG. 3 is a graph showing results of a multiple stimuli with hidden reference and anchor (MUSHRA) experiment in which a wideband signal is extended to a super wideband signal.

FIG. 3 is a graph showing results of a multiple stimuli with hidden reference and anchor (MUSHRA) test, in which a wideband signal is extended into a super wideband signal.

Referring to FIG. 3, each column shows an average point of all test participants with regard to audio files, in which a maximum value is 100 points. In the apparatus and method for extending a bandwidth of a sound signal according to the embodiment of the invention, when HMM training is applied, the score was 75.5, which was superior in terms of sound quality to ITU-T.G.729.1SWB (layer 2) and ITU-T.G.729.1SWB (layer 12), but inferior to ITU-T.G.729.1SWB (layer 3) and ITU-T.G.729.1SWB (layer 13). This result shows that sound quality cannot go beyond ITU-T.G.729.1SWB when there is no additional bit assignment.

The present invention may further include other embodiments in addition to the foregoing embodiment. For example, if a wideband signal is input, it may be extended into a super wideband signal. For instance, if a wideband signal of about 0-8 kHz is input, it can be extended into a super wideband signal of 0-16 kHz. Alternatively, the super wideband signal may be obtained when the narrowband signal is input. In this case, the extension method in the extender 6, the number of MDCT coefficients, and the like may be changed.

According to yet another embodiment, it is possible to replicate the MDCT coefficient of the low band signal into an MDCT coefficient of a high band signal through simple shift of the MDCT coefficient without normalization, or through normalized or non-normalized inverse shift.

According to other embodiments, the narrowband signal $x_n(n)$ may be directly input to the synthesizer 9 and synthesized with an estimated high band signal without inverse IMDCT to provide a wideband signal.

According to the present invention, it is possible to realize a high quality call service under conditions that a communication network for the Internet is deteriorated. Further, it is possible to achieve a high quality call service without additional bit assignment. Therefore, the present invention can be more effectively used under a particular condition that the communication network for the Internet is deteriorated, and can improve user satisfaction.

Although some embodiments have been described herein, it should be understood by those skilled in the art that these embodiments are given by way of illustration only, and that various modifications, variations and alterations can be made without departing from the spirit and scope of the invention. The scope of the present invention should be defined by the following claims and equivalents thereof.

What is claimed is:

1. An apparatus for extending a bandwidth of a sound signal, the apparatus comprising:

a database configured to store predetermined training information generated as a result of at least one of Gaussian mixture model (GMM) training and hidden Markov model (HMM) training;

a modified discrete cosine transform (MDCT) transformer configured to transform a first band signal through MDCT, and output an MDCT coefficient of the first band signal;

a normalizer configured to normalize the MDCT coefficient of the first band signal using the MDCT coefficient of the first band signal, subband energy of the first band signal and a cosine window and output the normalized MDCT coefficient to the extender;

a feature extractor configured to extract a feature parameter of the first band signal from the normalized MDCT coefficient of the first band signal output from the normalizer;

an extender configured to provide an extended MDCT coefficient for a second band signal based on the normalized MDCT coefficient of the first band signal;

a subband energy estimator configured to estimate subband energy of the second band signal with reference to the predetermined training information stored in the database, based on the feature parameter of the first band signal;

a second band signal generator configured to provide an estimated MDCT coefficient for the second band signal, based on the extended MDCT coefficient for the second band signal and the estimated subband energy of the second band signal;

an inverse MDCT transformer configured to provide an estimated second band signal by transforming the estimated MDCT coefficient for the second band signal through inverse MDCT; and a synthesizer configured to obtain a third band signal by synthesizing the estimated second band signal and the first band signal.

2. The apparatus according to claim 1, wherein the feature parameter comprises a subband energy vector of the first band signal.

3. The apparatus according to claim 1, wherein the first band signal comprises a low band signal, and the third band signal comprises a wideband signal.

4. The apparatus according to claim 1, wherein the first band signal is inputted to the synthesizer without the MDCT.

5. The apparatus according to claim 1, wherein the extender is configured to provide the extended MDCT coefficient for the second band signal by applying correlation-based spectral band replication to the MDCT coefficient of the first band signal.

6. The apparatus according to claim 1, wherein the first band signal comprises a wideband signal, and the third band signal comprises a super wideband signal.

7. The apparatus according to claim 1, wherein the first band signal comprises a narrowband signal, and the third band signal comprises a super wideband signal.

8. The apparatus according to claim 1, wherein the first band signal is inputted to the synthesizer after undergoing the MDCT and the inverse MDCT.

9. The apparatus according to claim 1, wherein the normalizer is configured to normalize the MDCT coefficient of the first band signal by using Equation 1:

$$\bar{S}_n(k) = \begin{cases} S_n(k),\ 0 \le k < 16 \\ \dfrac{S_n(k)\omega(k-16(b-1))}{E_n(b-1)} + \dfrac{S_n(k)\omega(k-16b)}{E_n(b)},\ 16 \le k \le 144 \\ \dfrac{S_n(k)}{E_n(b-1)},\ 144 \le k \le 160 \end{cases},$$

where $\bar{S}_n(k)$ is the normalized MDCT coefficient of $k^{th}$ frequency band of the first band signal, $S_n(k)$ is the MDCT coefficient of $k^{th}$ frequency band of the first band signal, $E_n(b)$ is subband energy of the first band signal in the $b^{th}$ subband, $b=\lfloor k/16 \rfloor$, and $\omega(l)$ is a cosine window having a length of 32, wherein the feature extractor is configured to extract the feature parameter of the first band signal from the normalized MDCT coefficient of the first band signal, and wherein the extender is configured to provide the extended MDCT coefficient for the second band signal based on the normalized MDCT coefficient of the first band signal.

10. The apparatus according to claim 9, wherein the second band signal generator is configured to provide the estimated MDCT coefficient for the second band signal by using Equation 2 and Equation 3, wherein the Equation 2 is:

$$\tilde{S}'_h(k) = \begin{cases} \bar{S}_n(k)\hat{E}_h(b),\ 0 \le k < 16 \\ \bar{S}_n(k)\hat{E}_h(b-1)\omega(k-16(b-1)) + \bar{S}_n(k)\hat{E}_h(b)\omega(k-16b),\ 16 \le k < 144 \\ \bar{S}_n(k)\hat{E}_h(b-1),\ 16 \le k < 144 \end{cases},$$

where $\hat{E}_h(b)$ is $b^{th}$ estimated subband energy of the second band signal, and wherein the Equation 3 is:

$$S_{abe(k)} = (0.25 \cdot |\hat{S}'_h(k)| + 0.25 \cdot |S_{abe}(k-1)| \cdot \mathrm{sgn}(\hat{S}'_h(k)),$$

where $S_{abe}(k)$ is the estimated MDCT coefficient of $k^{th}$ frequency band of the second band signal, and sgn(x) becomes 1 when x is equal to or higher than 0 but otherwise becomes −1.

11. A method of extending a bandwidth of a sound signal, the method comprising:

estimating a second band signal based on a first band signal; and obtaining a third band signal by synthesizing the first band signal and the estimated second band signal, wherein said estimating the second band signal comprises:

estimating subband energy of the second band signal with reference to information about Gaussian mixture model (GMM) training or hidden Markov model (HMM) training, stored in a database, based on a feature parameter of the first band signal;

obtaining an extended modified discrete cosine transform (MDCT) coefficient for the second band signal based on an MDCT coefficient of the first band signal; and obtaining an estimated MDCT coefficient of the second band signal based on the estimated subband energy of the second band signal and the extended MDCT coefficient for the second band signal, wherein the MDCT coefficient of the first band signal is normalized using the MDCT coefficient of the first band signal, subband energy of the first band signal and a cosine window.

12. The method according to claim 11, wherein the extended MDCT coefficient for the second band signal is obtained by applying correlation-based spectral band replication to the MDCT coefficient of the first band signal.

13. The method according to claim 11, wherein the first band signal comprises a low band signal and the third band signal comprises a wideband signal.

14. The method according to claim 11, wherein the first band signal comprises a wideband signal, and the third band signal comprises a super wideband signal.

15. The method according to claim 11, wherein the first band signal comprises a narrowband signal, and the third band signal comprises a super wideband signal.

16. The method according to claim 11, wherein, in said obtaining the third band signal, the first band signal is synthesized without the MDCT.

17. The method according to claim 11, wherein, in said obtaining the third band signal, the first band signal is synthesized after undergoing the MDCT and the inverse MDCT.

18. The method according to claim 11, wherein the MDCT coefficient of the first band signal is normalized by using Equation 1:

$$\bar{S}_n(k) = \begin{cases} S_n(k),\ 0 \le k < 16 \\ \dfrac{S_n(k)\omega(k-16(b-1))}{E_n(b-1)} + \dfrac{S_n(k)\omega(k-16b)}{E_n(b)},\ 16 \le k \le 144 \\ \dfrac{S_n(k)}{E_n(b-1)},\ 144 \le k \le 160 \end{cases},$$

where $\bar{S}_n(k)$ is the normalized MDCT coefficient of $k^{th}$ frequency band of the first band signal, $S_n(k)$ is the MDCT coefficient of $k^{th}$ frequency band of the first band signal, $E_n(b)$ is subband energy of the first band signal in the $b^{th}$ subband, $b=\lfloor k/16 \rfloor$, and $\omega(l)$ is a cosine window having a length of 32, wherein the feature parameter of the first band signal is extracted from the normalized MDCT coefficient of the first band signal, and wherein the extended MDCT coefficient for the second band signal is obtained based on the normalized MDCT coefficient of the first band signal.

19. The method according to claim 18, wherein the estimated MDCT coefficient for the second band signal is obtained by using Equation 2 and Equation 3, wherein the Equation 2 is:

$$\tilde{S}'_h(k) = \begin{pmatrix} \overline{S}_n(k)\hat{E}_h(b),\ 0 \le k < 16 \\ \overline{S}_n(k)\hat{E}_h(b-1)\omega(k-16(b-1)) + \overline{S}_n(k)\hat{E}_h(b)\omega(k-16b),\ 16 \le k < 144 \\ \overline{S}_n(k)\hat{E}_h(b-1),\ 16 \le k < 144 \end{pmatrix},$$

where $\hat{E}_h(b)$ is $b^{th}$ estimated subband energy of the second band signal, and wherein the Equation 3 is:

$$S_{abe(k)} = (0.25 \cdot |\hat{S}'_h(k)| + 0.25 \cdot |S_{abe}(k-1)| \cdot \mathrm{sgn}(\hat{S}'_h(k)),$$

where $S_{abe}(k)$ is the estimated MDCT coefficient of $k^{th}$ frequency band of the second band signal, and sgn(x) becomes 1 when x is equal to or higher than 0 but otherwise becomes −1.

* * * * *